US006615508B1

(12) United States Patent
Valle

(10) Patent No.: US 6,615,508 B1
(45) Date of Patent: Sep. 9, 2003

(54) FLOOR DRYING SYSTEM

(76) Inventor: Rosendo Valle, 103 W. Baylor, San Antonio, TX (US) 78204

( * ) Notice: Subject to any disclaimer, the term of this patent is extended or adjusted under 35 U.S.C. 154(b) by 0 days.

(21) Appl. No.: 10/251,260

(22) Filed: Sep. 20, 2002

Related U.S. Application Data

(60) Provisional application No. 60/329,060, filed on Oct. 12, 2001.

(51) Int. Cl.[7] ..... F26B 19/00
(52) U.S. Cl. ..... 34/201; 34/218; 34/618
(58) Field of Search ..... 34/201, 218, 618, 34/620, 622, 230, 232, 233

(56) References Cited

U.S. PATENT DOCUMENTS 3,286,368 A * 11/1966 Thomas ..... 34/618
4,145,821 A * 3/1979 Schantz ..... 34/237
6,202,322 B1 * 3/2001 Turner, IV ..... 34/618

* cited by examiner

*Primary Examiner*—Gregory Wilson
(74) *Attorney, Agent, or Firm*—Joseph N. Breaux

(57) ABSTRACT

A floor drying system that includes a housing have rollable wheels and a combination heater/blower mechanism for generating a heated air flow wherein ambient temperature air flow caused to enter the housing from the top, heated within the housing and forced to exit the housing through the four sides and bottom; the heated air exiting at angles directed toward the floor upon which the housing is supported; the top of the housing being provided with a caution strobe light which emits a strobe light action when the system is in operation.

1 Claim, 2 Drawing Sheets

FLOOR DRYING SYSTEM

This application claims the benefit of Provisional application Ser. No. 60/329,060, filed Oct. 12, 2001.

TECHNICAL FIELD

The present invention relates to mechanisms and systems for drying floors which have been mopped or which have water spilled thereon and more particularly to a floor drying system that includes a housing have rollable wheels and a combination heater/blower mechanism for generating a heated air flow wherein ambient temperature air is caused to enter the housing from the top, heated within the housing and forced to exit the housing through the four sides and bottom; the heated air exiting at angles directed toward the floor upon which the housing is supported; the top of the housing being provided with a caution strobe light which emits a strobe light action when the system is in operation.

BACKGROUND ART

It is often important that floors that have been recently mopped or which have become wet due to rainy conditions or spills to rapidly dry the floors so that the floor will be safe to walk on. It would be desirable, therefore, to have a floor drying system which would aid in the evaporation of the light film of water which remains after the floor has been mopped. In addition, because it is important to alert individuals in the area that the floor may be slippery, it would be a further benefit if the floor drying system included an alerting mechanism such as a caution strobe light which would draw attention to the device and the wet floor condition.

GENERAL SUMMARY DISCUSSION OF INVENTION

It is thus an object of the invention to provide a floor drying system that includes a housing have rollable wheels and a combination heater/blower mechanism for generating a heated air flow wherein the ambient temperature air is caused to enter the housing from the top, heated within the housing and forced to exit the housing through the four sides and bottom; the heated air exiting at angles directed toward the floor upon which the housing is supported; the top of the housing being provided with a caution strobe light which emits a strobe light action when the system is in operation.

Accordingly, a floor drying system is provided. The floor drying system includes a housing have rollable wheels and a combination heater/blower mechanism for generating a heated air flow wherein ambient temperature air is caused to enter the housing from the top, heated within the housing and forced to exit the housing through the four sides and bottom; the heated air exiting at angles directed toward the floor upon which the housing is supported; the top of the housing being provided with a caution strobe light which emits a strobe light action when the system is in operation.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
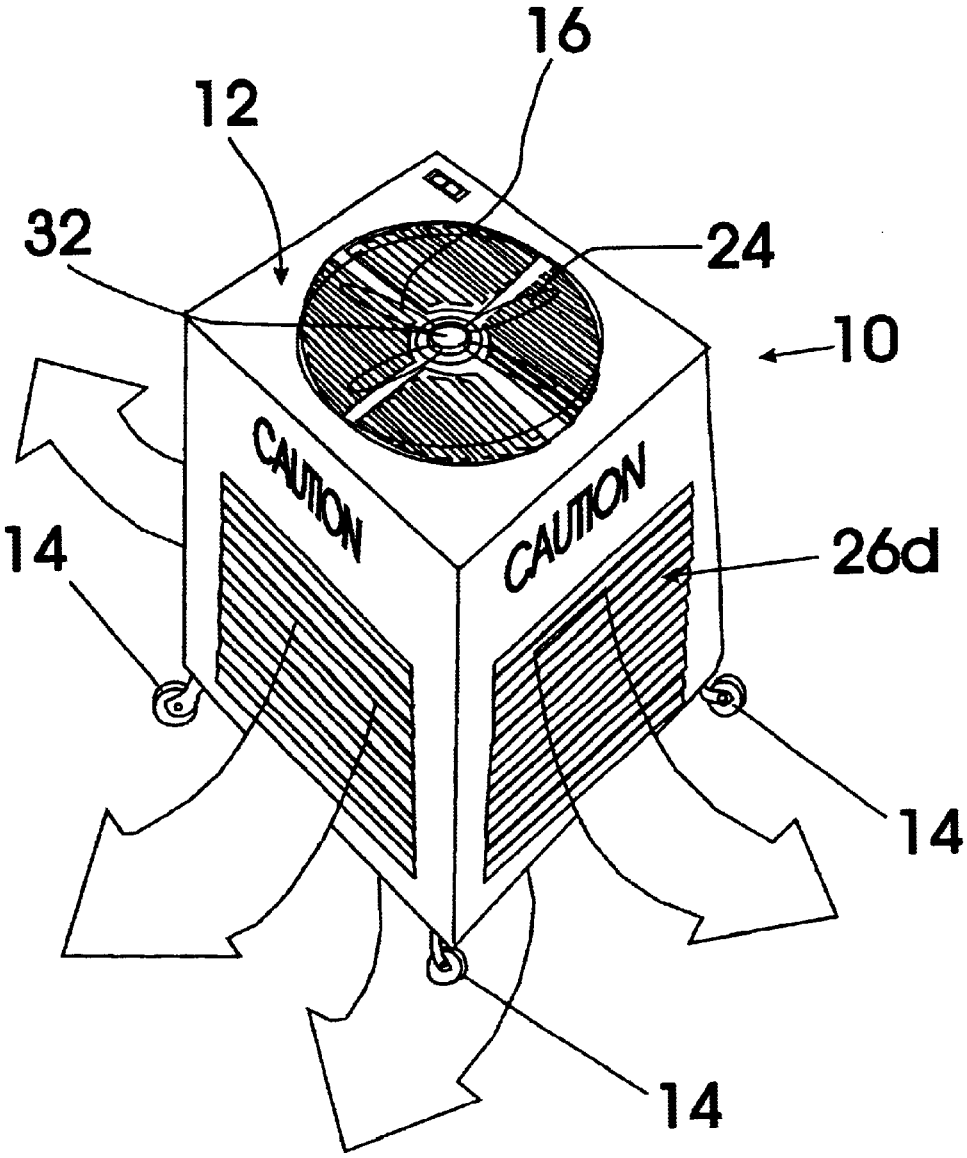
FIG. 1 is a perspective view of an exemplary embodiment of the floor drying system.
Figure 3:
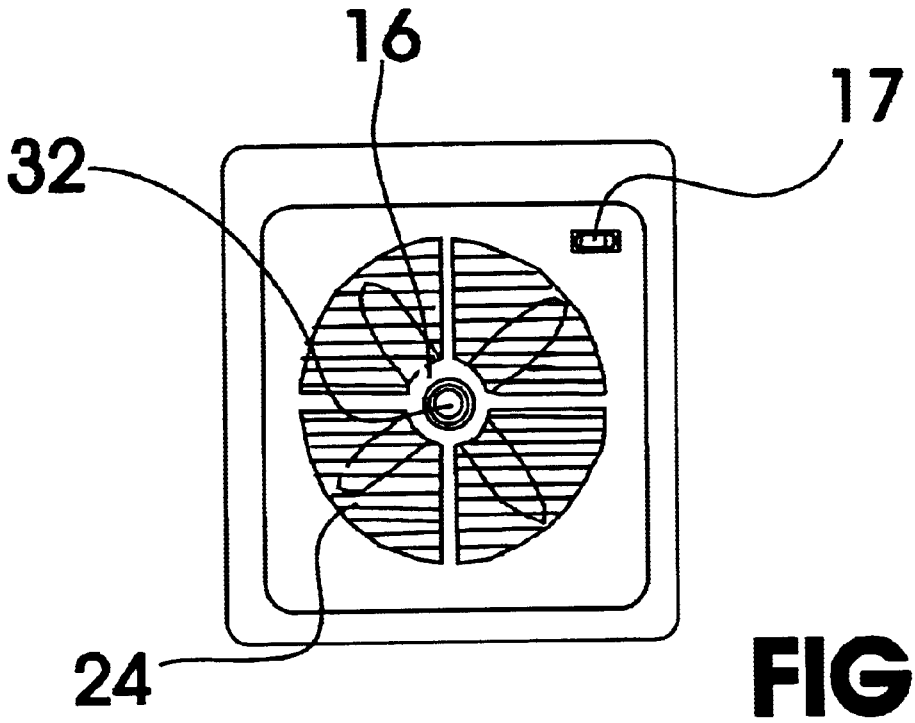
FIG. 3 is a top plan view of the floor drying system.
Figure 2:
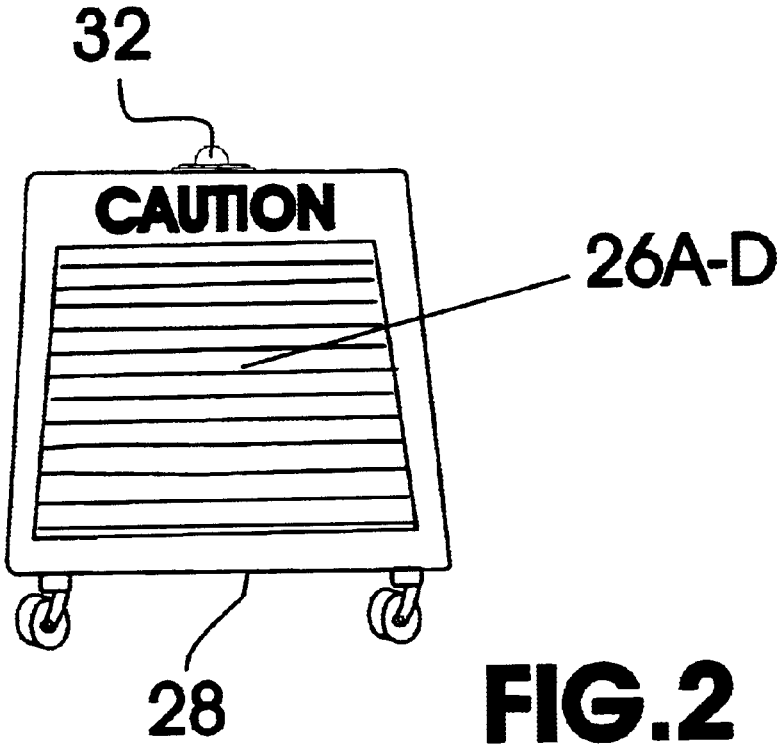
FIG. 2 is a side plan view of the floor drying system.

FIGS. 1–3 show various aspects of an exemplary embodiment of the floor drying system of the present invention generally designated 10. Floor drying system 10 includes a housing, generally designated 12, having rollable wheels 14 and a combination heater/blower mechanism 16 for generating a heated air flow wherein ambient temperature air is caused to enter the housing through a top grate 24, heated within the housing and forced to exit the housing through the four sidewall grates 26 a–d and bottom 28; the heated air exiting at angles directed toward the floor upon which the housing is supported. The combination heater/blower mechanism 16 is controlled by a three-position heater/blower control switch, generally designated 17, that includes a position for "off", a position for turning just the "blower on" which causes just the blower to operate, and a position "both on" for causing both the heater and the blower to operate.

The top of the housing is provided with a caution strobe light assembly 32 which emits a strobe light action when the three-position switch is in the "blower on" or the "both on" position.

It can be seen from the preceding description that a floor drying system has been provided.

It is noted that the embodiment of the floor drying system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A floor drying system comprising:

a housing have rollable wheels and a combination heater/blower mechanism for generating a heated air flow wherein ambient temperature air is caused to enter the housing from a top, heated within the housing and forced to exit the housing through four sidewall grates and a bottom at angles directed toward a floor upon which the housing is supported;

the top of the housing being provided with a caution strobe light which emits a strobe light action when the floor drying system is in operation.

* * * * *